US008374526B2

(12) United States Patent
Ju et al.

(10) Patent No.: US 8,374,526 B2
(45) Date of Patent: Feb. 12, 2013

(54) TRANSFER UNIT AND IMAGE FORMING APPARATUS HAVING THE SAME

(75) Inventors: Jeong-Yong Ju, Hwaseong-Si (KR); Jun-Ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 298 days.

(21) Appl. No.: 12/782,256

(22) Filed: May 18, 2010

(65) Prior Publication Data

US 2011/0064464 A1 Mar. 17, 2011

(30) Foreign Application Priority Data

Sep. 15, 2009 (KR) ..... 10-2009-0086954

(51) Int. Cl.
*G03G 15/08* (2006.01)

(52) U.S. Cl. ..... 399/121; 399/313; 399/317

(58) Field of Classification Search ..... 399/121, 399/302, 313, 317
See application file for complete search history.

(56) References Cited

FOREIGN PATENT DOCUMENTS

JP 2004-163795 6/2004

OTHER PUBLICATIONS

English language abstract of JP 2004-163795, published Jun. 10, 2004.

Machine English language translation of JP 2004-163795, published Jun. 10, 2004.

*Primary Examiner* — Hoang Ngo

(74) *Attorney, Agent, or Firm* — Stanzione & Kim, LLP

(57) ABSTRACT

Disclosed are a transfer unit and an image forming apparatus. The image forming apparatus includes a main body frame on which one or more image carrying bodies are is supported and a transfer unit coupled to the main body frame. The transfer unit receives one or more images respectively from the one or more image carrying bodies, and may include, for example, an intermediate transfer belt for receiving thereon the one or more images, a transfer roller corresponding to an image carrying body and movable between a first position at which the transfer roller contacts the image carrying body and a second position at which the transfer roller is spaced apart from the image carrying body, an elastic member elastically biasing the transfer roller toward the first position and a guide structure that guides the movement of the transfer roller in a manner opposing the elastic force of the elastic member so as to reduce the speed at which the transfer roller moves from the second position to the first position and to thereby reduce the force of impact with which the transfer roller makes contact with the image carrying body.

23 Claims, 11 Drawing Sheets

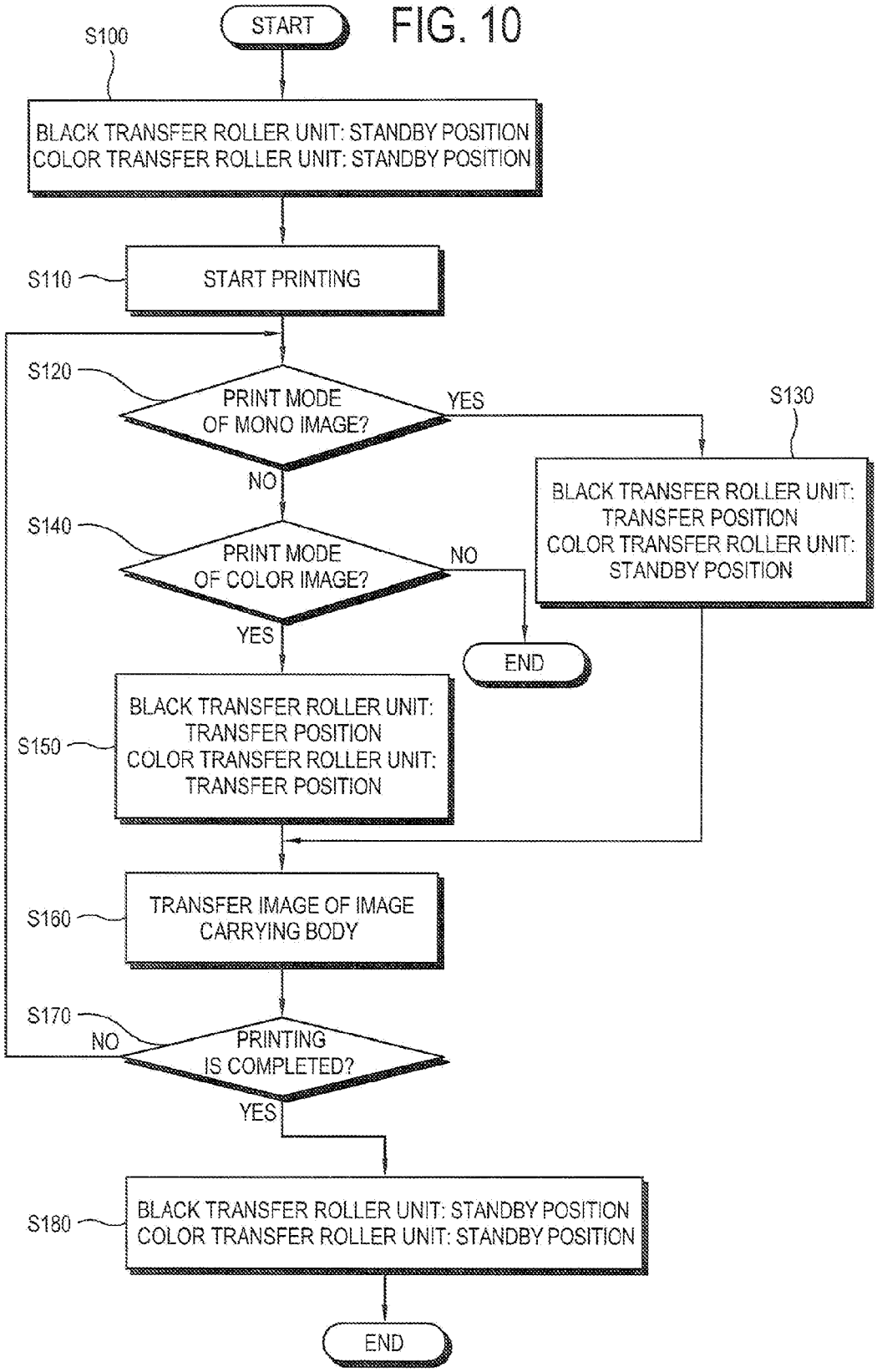
FIG. 10
START
S100
BLACK TRANSFER ROLLER UNIT: STANDBY POSITION
COLOR TRANSFER ROLLER UNIT: STANDBY POSITION
S110
START PRINTING
S120
PRINT MODE OF MONO IMAGE?
YES
NO
S130
BLACK TRANSFER ROLLER UNIT: TRANSFER POSITION
COLOR TRANSFER ROLLER UNIT: STANDBY POSITION
S140
PRINT MODE OF COLOR IMAGE?
NO
YES
END
S150
BLACK TRANSFER ROLLER UNIT: TRANSFER POSITION
COLOR TRANSFER ROLLER UNIT: TRANSFER POSITION
S160
TRANSFER IMAGE OF IMAGE CARRYING BODY
S170
PRINTING IS COMPLETED?
NO
YES
S180
BLACK TRANSFER ROLLER UNIT: STANDBY POSITION
COLOR TRANSFER ROLLER UNIT: STANDBY POSITION
END

TRANSFER UNIT AND IMAGE FORMING APPARATUS HAVING THE SAME

CROSS-REFERENCE TO RELATED APPLICATION

This application claims priority from Korean Patent Application No. 10-2009-0086954, filed on Sep. 15, 2009 in the Korean Intellectual Property Office, the entire disclosure of which is incorporated herein by reference.

TECHNICAL FIELD

The present disclosure relates generally to a transfer unit for transferring an image from an image carrying body and an image forming apparatus having the same, and more particularly, to a transfer unit of improved configuration of a transfer roller unit opposing an image carrying body with an intermediate transfer belt interposed therebetween and an image forming apparatus having the same.

BACKGROUND OF RELATED ART

An image forming apparatus is an apparatus that forms a visible image with ink, or developer such as, for example, toner, on a printing medium, and may be designed for one or both of forming a color image by the use of multiple color ink or developer and forming a monochromatic, i.e., black and white, image using only the black ink or developer.

In such image forming apparatus, in order for color images, a number of developing cartridges corresponding to the number of different colors of the developer being used may be provided. Each developing cartridge may have an associated image carrying body on which a visible image of individual color is to be formed. The individual color images on the image carrying bodies are then transferred onto a transfer medium in cooperation with a transfer member such as transfer rollers that respectively oppose and press against the image carrying bodies in such a manner that the individual images overlap one over the other on the transfer medium to thereby form a full color image expressed as the overlapped combination of the individual color images.

When however a monochromatic image is formed, it is not necessary that all of the developing operate as only the developing cartridge corresponding to the black color developer is required to form the black image. Accordingly, It is also known in the art that, during a monochromatic image forming operation, the image carrying bodies corresponding to colors other than the black color are not operated, that those transfer rollers corresponding to the non-operating image carrying bodies may be separated away from the image carrying bodies to thereby minimize the wear and tear, and thus to prolong the life, of the image carrying bodies, and that such transfer rollers may be moved back into the position of pressing against the corresponding image carrying body as needed, i.e., when forming a color image.

When a transfer roller moves back into the pressing relation with an image carrying body as above described, due to the movement momentum of the transfer roller, the image carrying body may be subjected to an impact force. Over time, the repeated application of such force on an image carrying body may lead to a physical deformation such as abrasion, a crack, etc. in certain areas of the image carrying body, which may in turn lead to the deterioration of the image quality.

SUMMARY OF DISCLOSURE

According to an aspect of the present disclosure, an image forming apparatus may be provided to include a main body frame, an image carrying body and a transfer unit. The image carrying body may be supported on the main body frame, and may have a surface on which to support an image. Transfer unit may be coupled to the main body frame, and may include an intermediate transfer belt, a transfer roller, an elastic member and a guide assembly. The intermediate transfer belt may be configured to receive the image from the image carrying body. The transfer roller may be configured to move between a first position at which the image from the image carrying body is transferred to the intermediate transfer belt and a second position at which the transfer roller is further away from the image carrying body than when the transfer roller is at the first position. The elastic member may elastically bias the transfer roller toward the first position. The guide assembly may be configured to guide the movement of the transfer roller in such a manner opposing the elastic force of the elastic member so as to cause the transfer roller to contact the image carrying body with a reduced force of impact when the transfer roller moves from the second position to the first position.

The guide assembly may be configured to reduce the movement speed at which the transfer roller moves from the second position to the first position.

The guide assembly may be configured to reduce the movement speed of the transfer roller unit in one or more stages.

The guide assembly may be configured to reduce the movement speed of the transfer roller unit gradually.

The guide assembly may comprise a slider member, a support guide and a driving unit. The slider member may be movably coupled to the main body frame. The support guide may be formed on the slider member, and may extend along a direction of movement of the slider member. The support guide may be arranged to contact at least a portion of the transfer roller so as to guide the transfer roller in such a manner allowing the position of the transfer roller to vary correspondingly with the movement of the slider member. The driving unit may be configured to drive the slider member to move.

The driving unit may comprise a cam member and a controller. The cam member may be rotationally driven by a driving force source, and may have a cam profile that selectively presses the slider member to move according to the rotational position of the cam member. The controller may be configured to control the rotational position of the cam member so as to allow the slider member to move selectively according to the selected printing mode of the image forming apparatus.

The transfer roller may comprise a roller body rotatable about a rotational shaft and a distance regulating member arranged on at least one end portion of the rotational shaft. The distance regulating member may be configured to contact the image carrying body to maintain a distance between the roller body and the image carrying body when the transfer roller unit is positioned in the first position.

The transfer roller may further comprise a holder and a holder protrusion. The holder may be configured to rotatably support the rotational shaft, and may be coupled to the elastic member so as to receive therefrom the elastic force. The holder protrusion may be formed on the holder, and may be supported by the support guide.

The support guide may comprise a first, second and a third support portions. The first support portion may be configured to support the transfer roller when the transfer roller is in the first position. The second support portion may be configured to support the transfer roller when the transfer roller is in the second position. The third support portion may be arranged between the first support portion and the second support portion so as to support the transfer roller in such a manner allowing the transfer roller to be positioned at least one intermediary position between the first position and the second position.

The support guide may further comprise an inclined portion arranged at least one of between the first support portion and the third support portion and between the third support portion and the second support portion. The inclined portion may be configured to guide at least one of the movement of the transfer roller from the first position to any one of the at least one intermediary position and the movement of the transfer roller from any one of the at least one intermediary position to the second position.

Alternatively, the third support portion may be arranged between the first support portion and the second support portion, and may define an arcuate guide path along which the transfer roller is guided to move between the first and second positions.

An angle between the tangent line of the third support portion at a support position of the transfer roller on the third support portion and a line parallel to the movement direction of the transfer roller may be made to be larger as the support position becomes closer to the first support portion.

The image supported on the image carrying body may be formed of black developer. The transfer unit may further comprise at least one additional transfer roller that may be arranged to be parallel to the transfer roller, and that may correspond to at least one additional image carrying body on which additional image formed of developer of at least one color other than black. The guide assembly may further comprise an additional slider member movably coupled to the main body frame and one or more additional support guides formed on the additional slider member. The one or more additional support guides may each extend along a direction of movement of the additional slider member, and may be arranged to contact at least a portion of corresponding one of the at least one additional transfer roller so as to guide the corresponding one of at least one additional transfer roller in such a manner allowing the position of the corresponding one of the at least one additional transfer roller to vary correspondingly with the movement of the additional slider member. The driving unit may further be configured to drive the additional slider member to move.

The driving unit may comprise a first cam member, a second cam member and a controller. The first cam member may have a first cam profile that is configured to press against the slider member and to thereby cause the slider member to move. The second cam member may be coupled coaxially with the first cam member, and may have a second cam profile that is configured to press against the additional slider member and to thereby cause the additional slider member to move. The controller may be configured to control the rotational positions of the first and second cam members so as to allow the slider member and the additional slider member to move selectively according to the selected one of printing modes in which the image forming apparatus is capable of operating.

The controller may be configured to control the rotational positions of the first and second cam members in such a manner that each of the transfer roller and the at least one additional transfer roller is positioned in the second position in a standby mode, in which mode the image forming apparatus does not perform a printing operation, that the transfer roller and the at least one additional transfer roller are positioned in the first position and in the second position, respectively, in a monochromatic printing mode, in which mode the image forming apparatus forms a monochromatic image, and that each of the transfer roller and the at least one additional transfer roller is positioned in the first position in a color printing mode, in which mode the image forming apparatus forms a color image.

According to another aspect of the present disclosure, a transfer, unit may be provided in an image forming apparatus for transferring an image formed on an image carrying body with developer, and may include an intermediate transfer belt, a transfer roller, an elastic member and a guide assembly. The image from the image carrying body may be transferred to the intermediate transfer belt. The transfer roller may be configured to move between a first position at which the image from the image carrying body is transferred to the intermediate transfer belt and a second position at which the transfer roller is further away from the image carrying body than when the transfer roller is at the first position. The elastic member may elastically bias the transfer roller toward the first position. The guide assembly may be configured to guide the movement of the transfer roller in such a manner opposing the elastic force of the elastic member so as to cause the transfer roller to contact the image carrying body with a reduced force of impact when the transfer roller moves from the second position to the first position.

According to yet another aspect of the present disclosure, an image transfer apparatus may be provided in an image forming apparatus for receiving an image from an image carrying body on which the image is developed with developer, and may include a transfer roller and a guide member. The transfer roller may be arranged to be movable along a first direction between at least a transfer position at which the image transfer apparatus receives the image from the image carrying body and a standby position at which the transfer roller is spaced apart from the image carrying body by a distance greater than when the transfer roller is positioned in the transfer position. The guide member may have a guide surface. At least a portion of which guide surface extends along a second direction not parallel to the first direction, and may be in an interfering contact with a portion of the transfer roller to thereby interfere with the movement of the transfer roller along the first direction at least when the transfer roller moves from the second position to the first position.

The guide member may comprise a first, second and a third support portions. The first support portion may extend substantially perpendicular to the first direction, and may be in contact with the portion of the transfer roller when the transfer roller is positioned in the transfer position. The second support portion may extend substantially perpendicular to the first direction, and may be in contact with the portion of the transfer roller when the transfer roller is positioned in the standby position. The third support portion may extend substantially perpendicular to the first direction, and may be in contact with the portion of the transfer roller when the transfer roller is positioned in an intermediary position between the transfer position and the standby position.

Alternatively, third support portion may extend curvedly between the first support portion and the second support portion, and may have a first radius of curvature at a first location adjacent the first support portion that is larger than a second radius of curvature at a second location adjacent to the second support portion.

The guide member may be configured to move along a direction perpendicular to the first direction.

BRIEF DESCRIPTION OF THE DRAWINGS

Various features and advantages of the disclosure will become more apparent by the following detailed description of several embodiments thereof with reference to the attached drawings, of which:

FIG. 10 is a flowchart illustrative of a selective control of the position of the transfer roller unit for various printing modes of the image forming apparatus in FIG. 1.

DETAILED DESCRIPTION OF SEVERAL EMBODIMENTS

Figure 1:
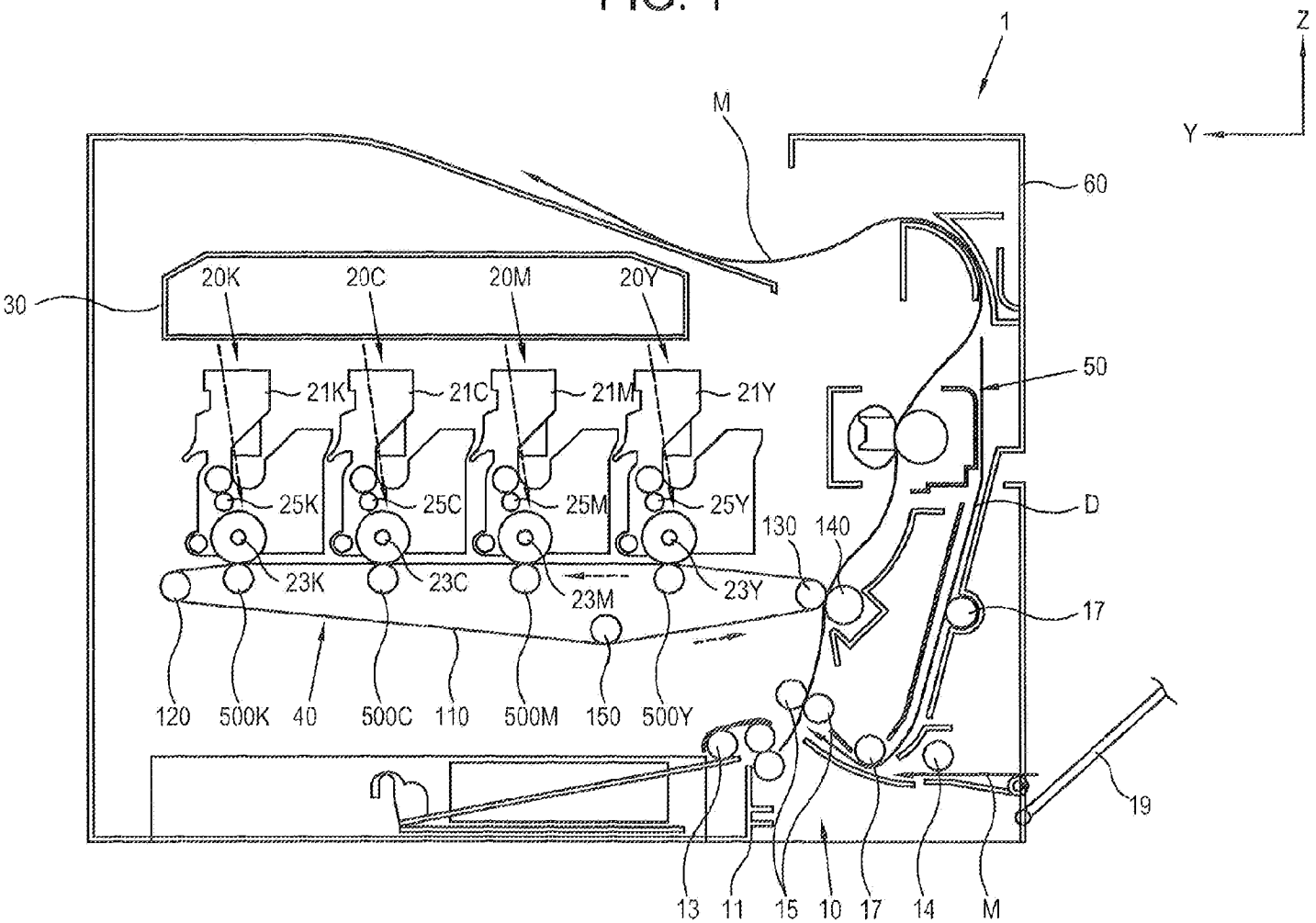
FIG. 1 is a side sectional view of an image forming apparatus according to an embodiment of the present disclosure.

Reference will now be made in detail to several embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not necessarily intended to be to true scale and may be exaggerated for the sake of allowing greater understanding.

Referring to FIG. 1, an image forming apparatus 1 according to an embodiment of the present disclosure may include image carrying bodies 23C, 23M, 23Y and 23K respectively corresponding to different colored developer, for example, cyan, magenta, yellow and black toner, and may be used selectively in forming a color image or a black and white image. FIG. 1 illustrates an intermediate transfer type image forming apparatus in which the visible images formed on the image carrying bodies 23C, 23M, 23Y and 23K are not transferred directly onto a printing medium M, but are first transferred onto an intermediate transfer medium such as, for example, the intermediate transfer belt 110 shown in FIG. 1.

As shown in FIG. 1, the image forming apparatus 1 according to an embodiment may include a medium supplying unit 10 for accommodating and for supplying the printing medium M, developing cartridges 20C, 20M, 20Y and 20K having respectively the image carrying bodies 23C, 23M, 23Y and 23K on each of which a visible developer image of the respective corresponding color is to be formed, an exposing unit 30 exposing the image carrying bodies 23C, 23M, 23Y and 23K to form electrostatic latent images corresponding to the image data of the desired image to be formed, a transfer unit 40 transferring the visible developer images formed to the image carrying bodies 23C, 23M, 23Y and 23K onto the printing medium M and a fusing unit 50 for fixing the image on the printing medium M.

The image forming apparatus 1 further includes a main body housing 60 accommodating therein the above mentioned elements. The main body housing 60 may include a main body frame (not shown) for supporting the elements of the image forming apparatus 1 in a suitable arrangement.

The medium supplying unit 10 may include a loading cassette 11 that may be detachably received in the main body housing 60 and a first pickup roller 13 configured to pick up and to supply the printing media M loaded in the loading cassette 11 one by one along the printing medium transport path within the main housing 60.

The registration roller(s) 15 is arranged to receive the printing medium picked up by the first pickup roller 13, and serves to align the leading end of the printing medium M and to further transport the printing medium M toward the transfer unit 40 at a predetermined timing. As the printing medium M passes through the transfer unit 40 and the fusing unit 50, an image is transferred and fixed on the surface thereof.

If images are to be formed on both sides of the printing medium M, duplex rollers 17 transport the printing medium M formed with an image on one side thereof in the reverse direction back toward the registration roller 15 along the duplex path D. The printing medium M transported by the duplex roller 17 along the duplex path D is supplied to the transfer unit 40 by the registration roller 15 at an appropriate timing so that an image may be formed on the other side of the printing medium M.

The medium supplying unit 10 may additionally include a loading tray 19 that may be rotatably supported on the main body housing 60. For example, the loading tray 19 be configured to rotate away from the main body housing 60 so as to provide a surface onto which the printing medium M may be loaded. The printing medium M loaded on the loading tray 19 may be picked up by a second pick up roller 14, and may be transported to the registration roller 15. The printing medium M picked up by the second pick up roller 14 may share a portion of the reverse transportation path D as its transport path toward the transfer unit 40.

The developing cartridges 20C, 20M, 20Y and 20K may correspond respectively to a plurality of colors. For example, the developing cartridges 20C, 20M, 20Y and 20K may be provided to each correspond respectively to developer of black, cyan, magenta and yellow, and may be removable independently of one another from the main body housing 60 for individual replacement.

The developing cartridge 20C, 20M, 20Y and 20K may include respective cartridge housings 21C, 21M, 21Y and 21K for storing the developer of corresponding color, the image carrying bodies 23C, 23M, 23Y and 23K on which a visible image of the respectively corresponding stored developer is to be formed and developing rollers 25C, 25M, 25Y and 25K that are configured to supplying the developer of the corresponding color on the image carrying bodies 23C, 23M, 23Y and 23K, respectively.

The image carrying bodies 23C, 23M, 23Y and 23K are exposed by the exposing unit 30 to each form an electrostatic latent image on the surface thereof. The developing roller 25C, 25M, 25Y and 25K each form the visible image by supplying the corresponding color developer to, and thus by developing, the electrostatic latent image of the respective corresponding image carrying bodies 23C, 23M, 23Y and 23K.

The transfer unit 40 may be configured to transfer the visible images formed on the image carrying body 23C, 23M, 23Y and 23K onto the printing medium M by serving as an intermediary medium between the image carrying bodies and the printing medium M. To that end, the transfer unit 40 may include an intermediate transfer belt 110 rotating to defined an endless loop in contact with the image carrying bodies 23C, 23M, 23Y and 23K in such an arrangement that allows the visible images to be transferred from the image carrying bodies 23C, 23M, 23Y and 23K to the intermediate transfer belt 110 in such a manner that the individual color images overlap one another to result in a full color image. The transfer unit 40 may further include a driving roller 120 for rotating the intermediate transfer belt 110, a final transfer roller 130 for transferring the full color visible image from the intermediate transfer belt 110 onto the printing medium M, a transfer backup roller 140 opposing the final transfer roller 130 and a tension roller 150 for maintaining a suitable tension in the intermediate transfer belt 110.

The transfer unit 40 may further include a first transfer roller unit and a second transfer roller unit each arranged to opposingly face corresponding respective one or more of the image carrying bodies 23C, 23M, 23Y and 23K with the intermediate transfer belt 110 interposed therebetween to realize the transfers of the visible images from the image carrying bodies 23C, 23M, 23Y and 23K to the intermediate transfer belt 110.

While each of the first and second transfer roller units may include any one or more of the transfer rollers 500C, 500M, 500Y and 500K, for convenience sake, an example in which the first transfer roller unit includes one transfer roller 500K corresponding to the black developer, and in which the second transfer roller unit includes the three transfer rollers 500C, 500M and 500Y corresponding respectively to the cyan, magenta and yellow developers, will be described. It should be understood however that such assignment of transfer rollers is merely an example.

One reason for such assignment of the transfer roller according to this example may be that the utilization of the transfer rollers 500C, 500M, 500Y and 500K may depend on whether the image transfer operation is performed in the monochromatic print mode or whether it is being performed in the color print mode. That is, since the formation of the image requires only the black developer in the monochromatic print mode involving only the transfer roller 500K while, in order to form a color image, transfer operation by each of the first transfer rollers 500C, 500M, 500Y and 500K may be required, the grouping of the transfer roller 500K as one unit and the remaining transfer rollers in the other group may be one convenient grouping.

Figure 2:
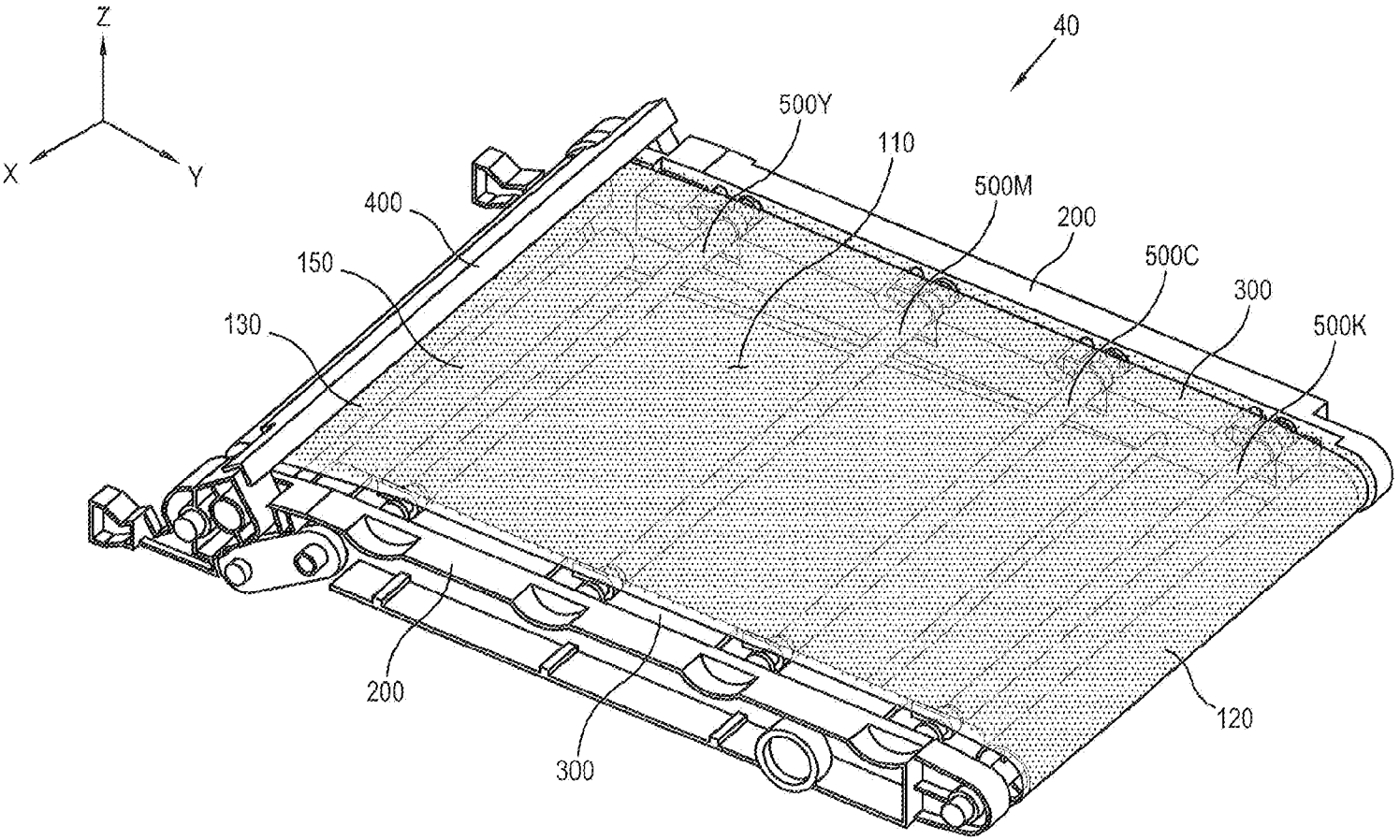
FIG. 2 is a perspective view of a transfer unit according to an embodiment of the present disclosure.

As shown in FIG. 2, the transfer unit 40 may include a first transfer unit frame 200 rotatably supporting thereon the driving roller 120, the final transfer roller 130 and the tension roller 150. The transfer unit 40 may further include a second transfer unit frame 300 coupled to the first transfer unit frame 200 for supporting thereon the transfer rollers 500C, 500M, 500Y and 500K. The transfer unit 40 may also include a cleaning blade 400 for cleaning the outer surface of the intermediate transfer belt 110 onto which the images from the image carrying bodies are to be transferred.

The first transfer unit frame 200 may be coupled to the main body frame (not shown), or may be integrally formed with the main body frame. The first transfer unit frame 200 may be configured in a pair of support members facing each other to support the opposite ends of the driving roller 120, the final transfer roller 130 and the tension roller 150. According to an embodiment, a pair of support members of the second transfer unit frames 300 may be disposed to inside of the pair of support members of the first transfer unit frames 200.

The second transfer unit frame 300 supports the opposite ends of the transfer rollers 500C, 500M, 500Y and 500K. The second transfer unit frame 300 may serve to guide the movement of the transfer rollers 500C, 500M, 500Y and 500K along the direction toward and away from the respective corresponding image carrying bodies 23C, 23M, 23Y and 23K, or toward and away from the inner surface of the intermediate transfer belt 110.

According to an embodiment, the first transfer roller unit, i.e., in this example, the transfer roller 500K, and the second transfer roller unit, i.e., for example, the transfer rollers 500C, 500M and 500Y, may be configured to be capable of moving independently from each other, for example, according to the current printing mode in which the image forming apparatus 1 is to operate. The printing modes may include, for example, a monochromatic printing mode, a color printing mode, a standby mode and the like.

Hereinafter, for the sake of descriptive convenience, the position in which, for each of the first transfer roller unit and the second transfer roller unit, the transfer roller unit is in the pressing relationship respectively with the image carrying body or bodies and in contact with the intermediate transfer belt 110 so as to be capable of performing an image transfer will be referred to as the transfer position whereas the position in which the transfer roller unit is spaced apart from the respective corresponding image carrying body or bodies and from the intermediate transfer belt 110 so as not to perform an image transfer will be referred to as the standby position.

In the monochromatic printing mode, the first transfer roller unit, i.e., in this example, the transfer roller 500K, may be maintained in the transfer position while the second transfer roller unit, for example, including the transfer rollers 500C, 500M and 500Y, may be maintained in the standby position. In the color printing mode, on the other hand, both the first transfer roller unit and the second transfer roller unit may be maintained in the transfer position. In the standby mode, in which no printing operation is to be carried out, both the first transfer roller unit and the second transfer roller unit may be maintained in the standby position.

The transfer unit 40 according to an embodiment may include a guide assembly 800 (see FIG. 3) that controls the movement of the first and second transfer roller units.

Figure 3:
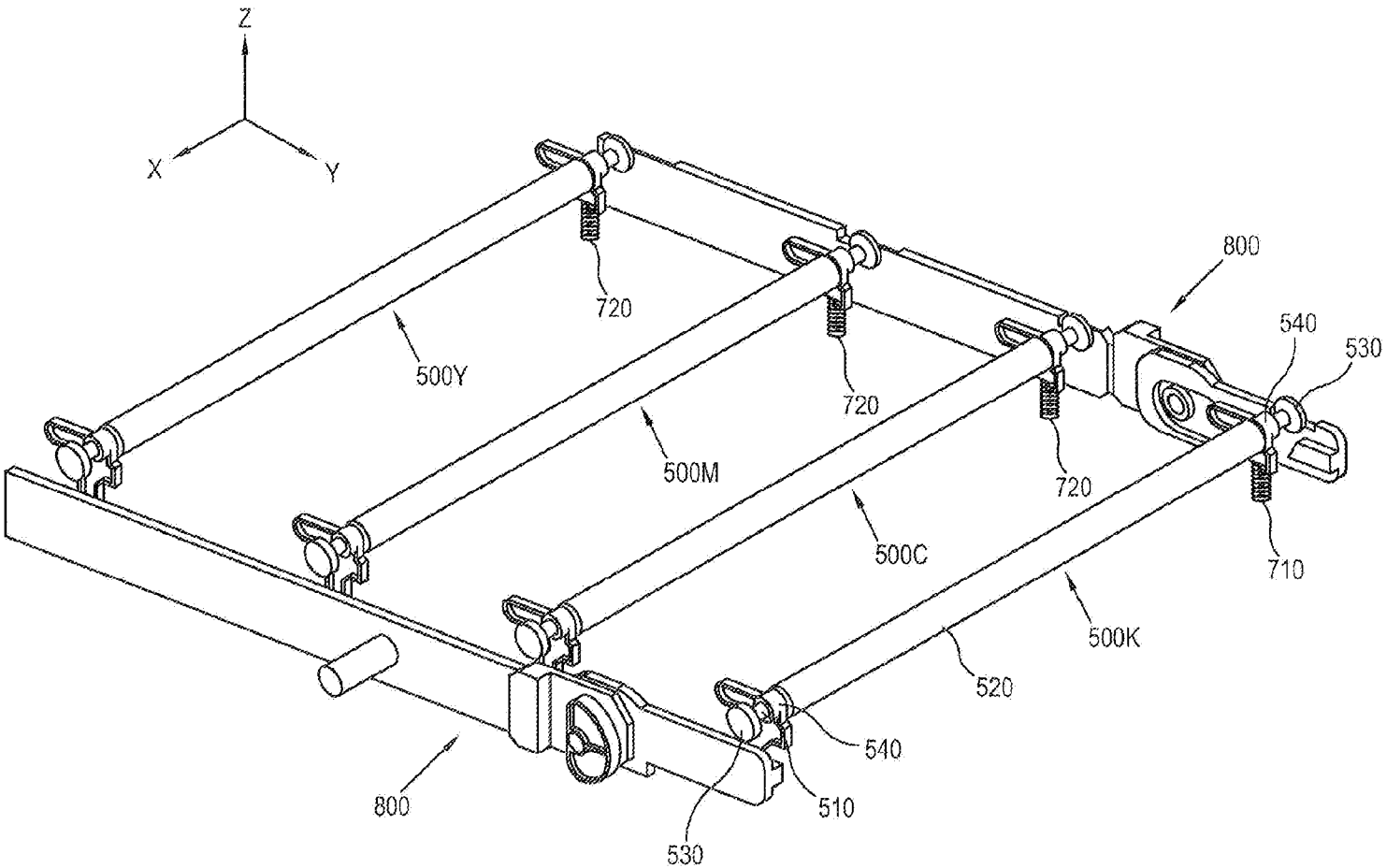
FIG. 3 is a perspective view of a transfer roller unit and a guide assembly according to an embodiment of the present disclosure.
Figure 4:
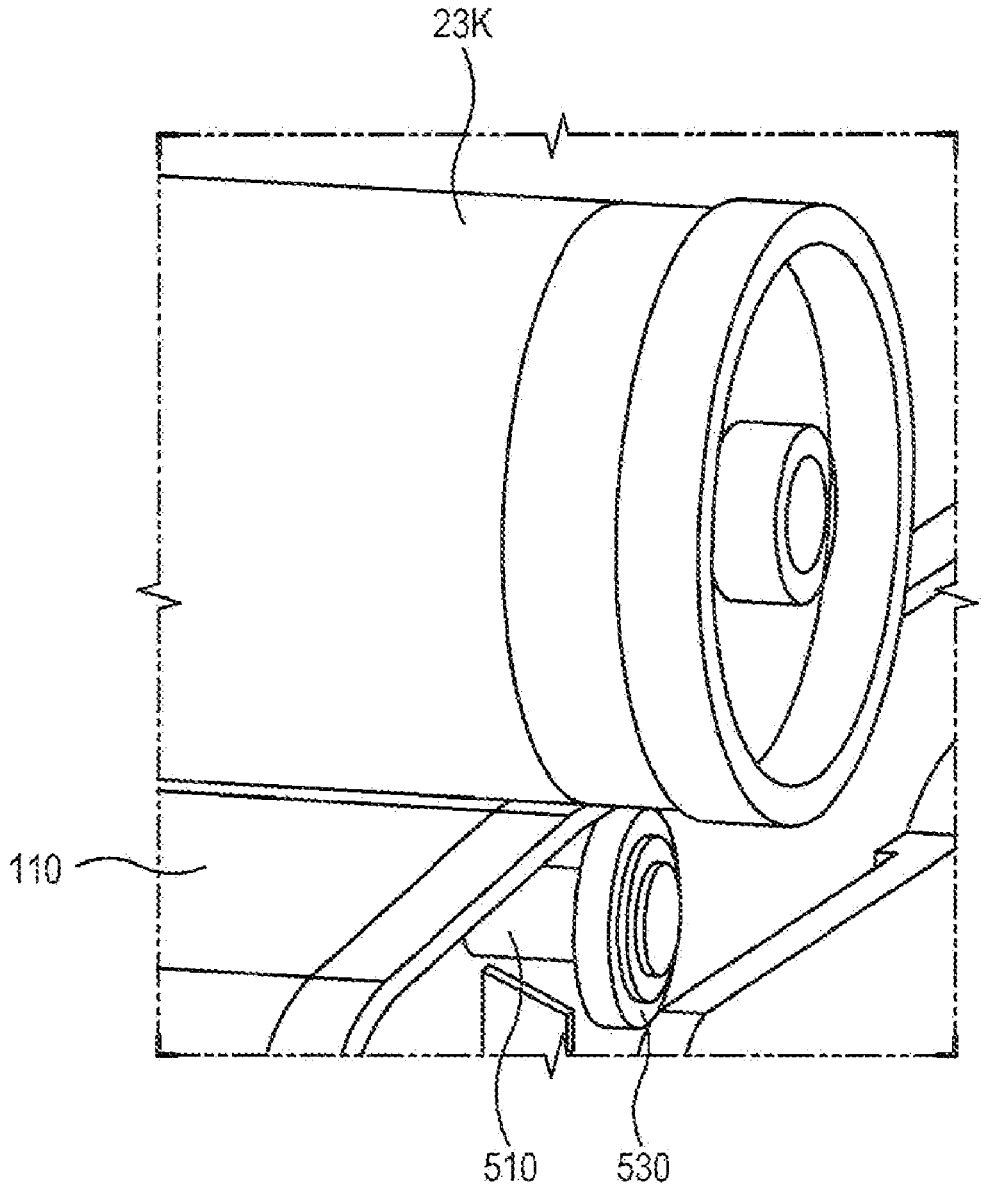
FIG. 4 is a perspective view illustrating the state that a distance member and an image carrying body being in contact each other when the transfer roller unit of FIG. 3 is positioned in the transfer position.

As shown in FIGS. 3 and 4, the transfer unit 40 according to an embodiment may include a first elastic member 710 elastically biasing the first transfer roller unit (for example, the transfer roller 500K) and one or more second elastic members 720 elastically biasing the second transfer roller unit (for example, transfer rollers 500C, 500M and 500Y).

The first elastic member 710 and/or the second elastic member 720 may be supported by the second transfer unit frame 300, and elastically bias the respective transfer roller unit toward the corresponding image carrying body and toward the intermediate transfer belt 110, that is, toward the transfer position. To that end, while various configurations of the first elastic member 710 and the second elastic member 720 may be possible, non-limiting implementation examples may include a coil spring, a leaf spring, a liquid spring, an elastic material such as rubber and the like.

Hereinafter, aspects of the configuration and/or arrangement of the transfer roller according to an embodiment of the present disclosure that may be shared commonly by the transfer rollers 500K, 500C, 500M and 500Y will be described in greater detail, for the sake of brevity, using as an illustrative example the transfer roller 500K corresponding to the black image. It is to be understood that such configuration and/or arrangement may be substantially equally applicable to the other transfer rollers 500C, 500M and 500Y. The transfer roller 500K according to an embodiment may include a roller 520 having a rotation shaft 510, distance regulating members 530 coupled to the opposite end portions of the rotation shaft 510 and a holder 540 rotatably supporting the rotation shaft 510. The holder 540 may be arranged to receive the elastic force from the first elastic member 710 as shown in FIG. 3.

The roller 520 may be arranged to oppose the image carrying body 23K with the intermediate transfer belt 110 interposed therebetween, and, when being positioned in the transfer position, may be electrically biased to achieve the transfer of the visible image from the image carrying body 23K to the intermediate transfer belt 110. Various material such as, for example, steel, may be used to form the roller 520. According to an embodiment, the roller 520 with the above described configuration may perform the transferring of the image without physically contacting the image carrying body 23K.

A distance regulating member 530 is disposed at each of the opposite end portions of the rotation shaft 510 so as not to contact to the intermediate transfer belt 110. The distance regulating members 530 come into contact with the image carrying body 23K so as to maintain an appropriate distance between the roller 520 and the image carrying body 23K when the transfer roller 500K is positioned in the transfer position. To such end, the distance regulating member 530 may have a larger diameter than the roller 520. The distance regulating members 530 may be formed of, for example, a plastic material having a good durability, taking into consideration the fact that of they come into physical contact with the image carrying body 23K.

When the transfer roller 500K moves from the standby position to the transfer position, and if the movement of the distance regulating members 530 is allowed to be accelerated by the elastic force of the first elastic member 710 until the distance regulating members 530 reaches the transfer position, the distance regulating member 530 may make contact with the image carrying body 23K with a significant force of impact.

That is, when the distance regulating members 530 move from the standby position to the transfer position, the elastic force of the first elastic member 710 causes the distance regulating members 530 to have a greater momentum, which in turn results in a greater impact force imparted on the image carrying body 23K. Such impacts may result in an abrasion or a crack in the image carrying body 23K at the positions of impact, and may in turn lead to the deterioration of the quality of the resulting image on the printing medium M.

Thus, according to an aspect of the present disclosure, the guide assembly 800 according to an embodiment may be configured to regulate the movements of the transfer rollers 500K, 500C, 500M and 500Y under the elastic forces of the first and second elastic members 710 and 720 in such a manner reducing the force of impact when the distance regulating members 530 come into contact with the image carrying bodies 23C, 23M, 23Y and 23K.

In order to reduce the force of impact, the guide assembly 800 may, for example, reduce the speed at which the transfer roller 500K moves under the elastic force from the standby position to the transfer position.

According to the general laws of physics, the impact force may be represented by the multiplication of the mass and the variation in velocity, i.e., acceleration. Because the mass is constant, in order to reduce the amount of the force, it may be necessary to reduce the amount of the acceleration. That is, the guide assembly 800 may be configured so as to reduce the amount of acceleration experienced by the distance regulating member 530 at the time it impacts the image carrying body 23K. As will be described in greater detail, the guide assembly 800 may be configured to reduce the respective acceleration of the other transfer rollers 500C, 500M and 500Y.

Figure 5:
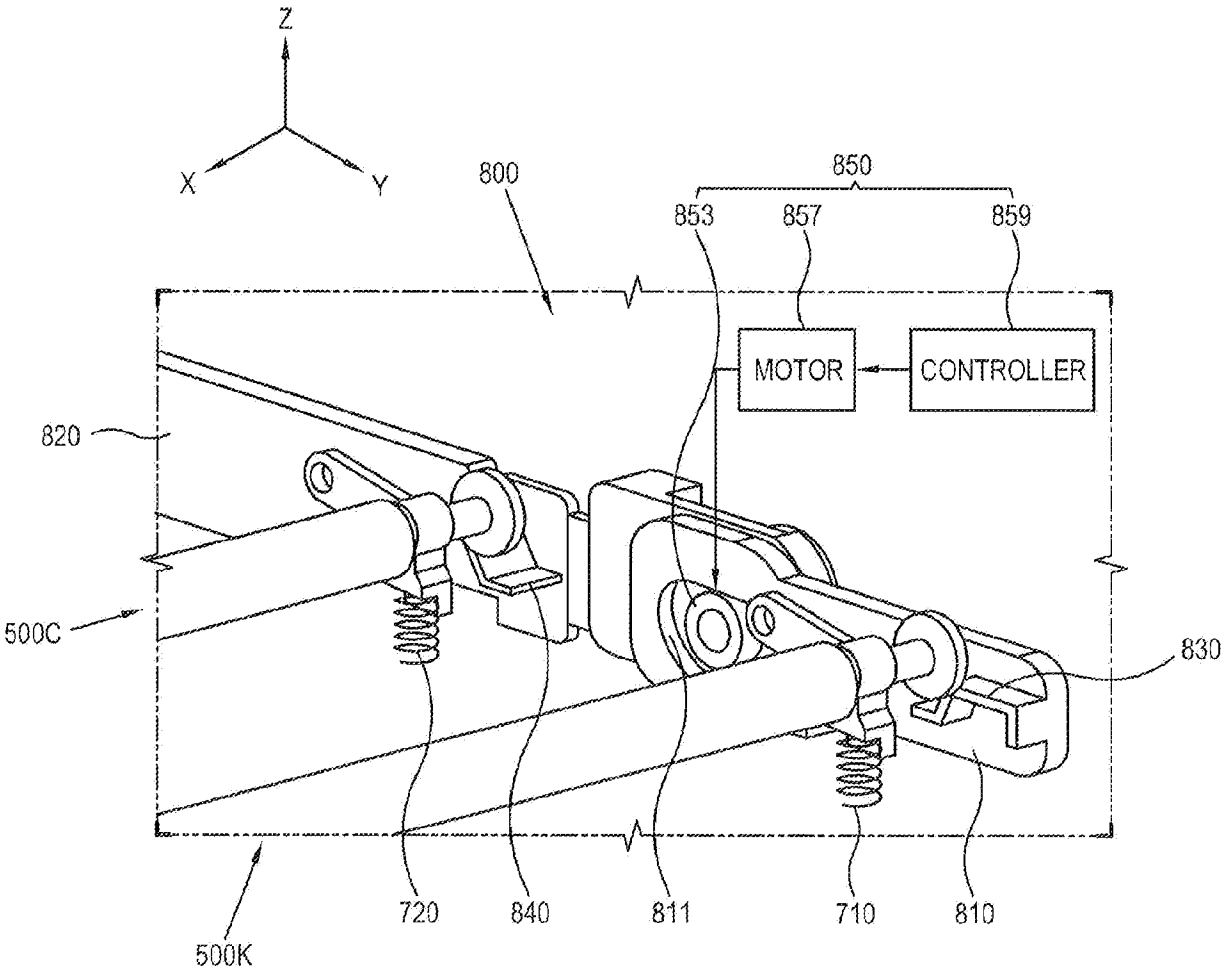
FIGS. 5 and 6 are perspective views taken at different viewing angles for illustration of relevant portions of the guide assembly of FIG. 3.
Figure 6:
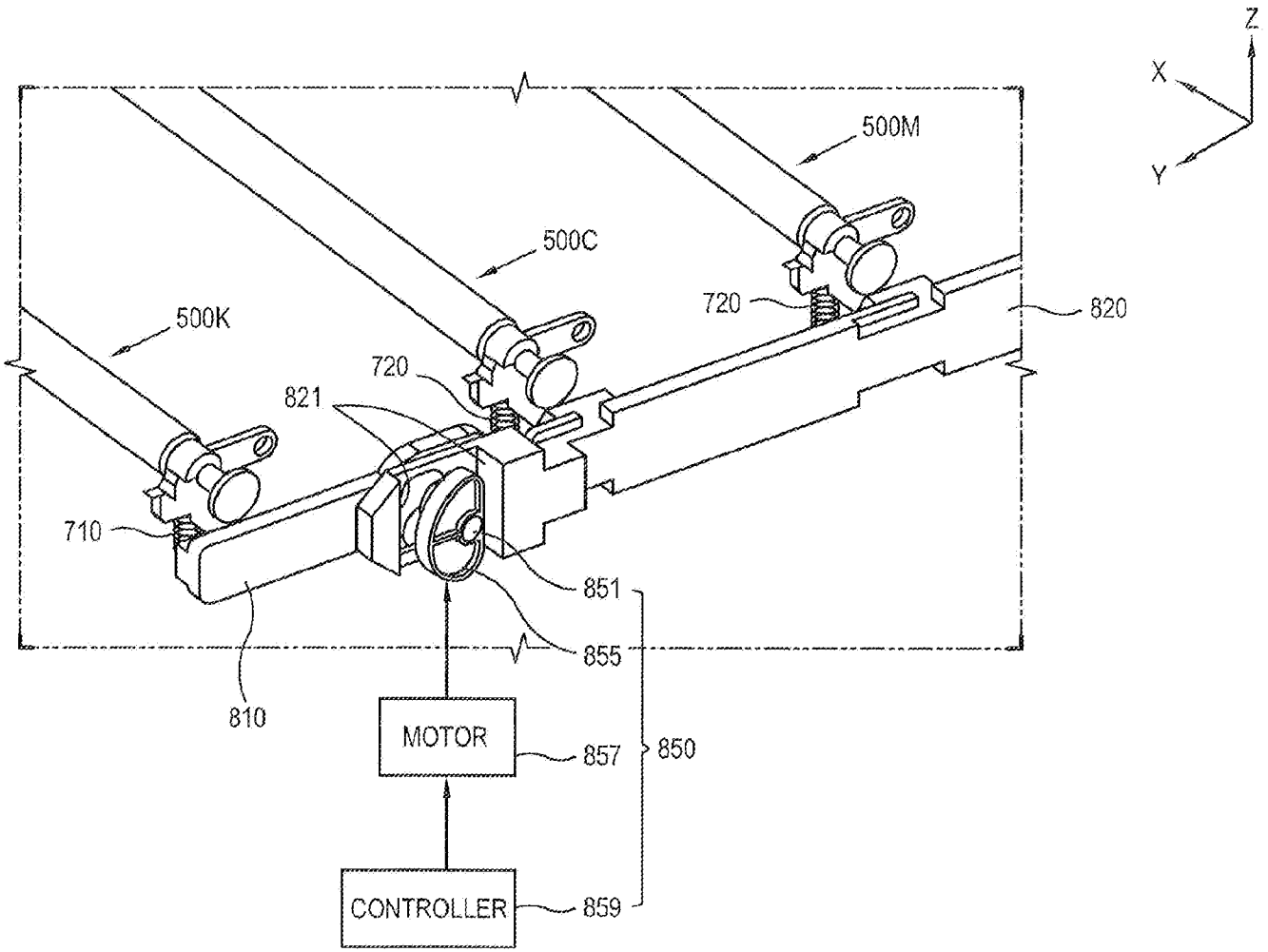

As shown in FIGS. 5 and 6, the guide assembly 800 according to an embodiment may include a first slider member 810 movably coupled to the first transfer unit frame 200 and a first support guide 830 formed on the first slider member 810 to regulate the movement of the transfer roller 500K.

The guide assembly 800 may further include a second slider member 820 movably coupled to the first transfer unit frame 200 and second support guides 840 formed on the second slider member 820 to regulate the movement respectively of the transfer rollers 500C, 500M and 500Y.

The guide assembly 800 may further include a driving unit 850 driving the movements of the first slider member 810 and the second slider member 820.

The first slider member 810 may be interposed between the first transfer unit frame 200 and the second transfer unit frame 300, and may extends in the direction Y that is perpendicular to the direction X along which the roller 520 extends. The first slider member 810 may be movable along the direction Y relative to the first transfer unit frame 200.

The first slider member 810 may have formed on one end portion thereof a hole through which a cam rotation shaft 851 may be received, and may have a pressed unit 811 formed adjacent the hole.

The pressed unit 811 provided in the first slider member 810 allows the cam profile of the first cam member 853 to press against it. As better illustrated in FIG. 8, the pressed unit 811 is respectively disposed in the direction Y and the direction −Y of the first cam member 853 so that the first slider member 810 can move in the direction Y and the direction −Y based on the rotation of the first cam member 853.

The first support guide 830 is disposed on a surface in the first slider member 810 facing the transfer roller 500K, that is, a surface facing the direction X as shown in FIG. 5. The first support guide 830 is configured to regulate the movement of the transfer roller 500K under the elastic force of the first elastic member 710, and to change the position of the transfer roller 500K to correspondence with the movement of the first slider member 810. That is, the first support guide 830 may extend generally parallel with the movement direction of the first slider member 810, and may regulate the height (i.e., along the direction Z shown in FIG. 5) of the transfer roller 500K to differ according to the movement of the first slider member 810 along its extending direction, i.e., along the Y and −Y directions.

The first support guide 830 may be provided to support a portion of the transfer roller 500K, for example, a holder protrusion unit 550 provided on the holder 540 (see FIG. 7) to thereby regulate the movement of the transfer roller 500K.

The first support guide 830 may be given a shape that allows the reduction in the movement speed of the transfer roller 500K when the transfer roller 500K moves from the standby position to the transfer position. While various shapes of the support guide 830 may be capable of reducing the movement speed of the transfer roller 500K, for example, by allowing the transfer roller 500K to move in steps, in stages or otherwise gradually, the first support guide 830 according to an embodiment of the present disclosure may have the stepped configuration as shown in FIG. 5, and will be described later in greater detail.

The second slider member 820 and the second support guide(s) 840 may have substantially the same configurations as the first slider member 810 and the first support guide 830.

According to an embodiment in which the second transfer roller unit includes the transfer rollers 500C, 500M and 500Y for respective colors of cyan, magenta and yellow, a second support guide 840 may be provided for each of transfer rollers 500C, 500M and 500Y on a single second slider member 820.

By providing a plurality of second support guides 840 on the single second slider member 820, and because, when forming a color image, all of cyan, magenta and yellow, rather than only any one single color, may typically be used, the transfer rollers 500C, 500M and 500Y of the three colors may be controlled to move together, which may prove more convenient.

The driving unit 850 may include the cam rotation shaft 851 passing through both the first slider member 810 and the second slider member 820, the first cam member 853 coupled to the cam rotation shaft 851 for moving the first slider member 810, a second cam member 855 coupled to the rotation shaft 851 for moving the second slider member 820, a motor 857 driving the cam rotation shaft 851 to rotate and a controller 859 controlling the motor 857.

According to an embodiment, as shown in FIGS. 5 and 6, the first cam member 853 and the second cam member 855 may be provided coaxially with respect to each other so that the movements of the first slider member 810 and the second slider member 820 can be affected by the single motor 857. It should be understood however that such configuration is merely an example and that the first cam member 853 and the second cam member 855 may alternative be configured to have separate rotational shafts.

The first cam member 853 and the second cam member 855 may each include a cam profile that is capable of pressing respectively the pressed unit(s) 811 of the first slider member 810 and the pressed unit(s) 821 of the second slider member 820 depending on the rotation angles of the first cam member 853 and the second cam member 855. Various shapes of the cam profile may be possible to affect the movements first slider member 810 and the second slider member 820 in substantially similar manner as further described below.

The motor 857 may rotates the cam rotation shaft 851 by a predetermined angle under the control by the controller 859.

That is, when the image forming apparatus 1 enters a particular printing mode, the controller 859 may drive the motor 857 in accordance with the intended printing mode so as to move the first slider member 810 and the second slider member 820 into the appropriate positions. To that end, according to an embodiment, one or more sensors (not shown) may be provided to sense the current angular position of the cam profile of the first cam member 853 and the second cam member 855, which angular positions may be used by the controller 859 in driving the motor 857. The controller 859 may, for example, adjust the time duration during which to drive the motor 857 based on the sensing result of the sensor (s) so that the cam profile can rotate to the desired new position appropriate for the intended printing mode.

The printing modes may include, for example, a standby mode, a monochromatic printing mode, a color printing mode and the like. The controller 859 according to an embodiment may move the first slider member 810 and the second slider member 820 selectively to one of the standby position and the transfer position based on the printing mode presently selected.

While a detailed structure of the controller 859 is not depicted in the figures, as would be readily understood by those skilled in the art, the controller 859 may be, e.g., a microprocessor, a microcontroller or the like, that includes a CPU to execute one or more computer instructions to implement the various control operations herein described relating to the transfer unit 40 and/or the control operations of one or more of other components of the image forming apparatus 1, such as, for example, one or more of the medium supplying unit 10, the exposing unit 30, the developing cartridges 20C, 20M, 20Y and 20K, and the fusing unit 50, and to that end may further include a memory device, e.g., a Random Access Memory (RAM), Read-Only-Memory (ROM), a flesh memory, or the like, to store the one or more computer instructions.

Figure 7:
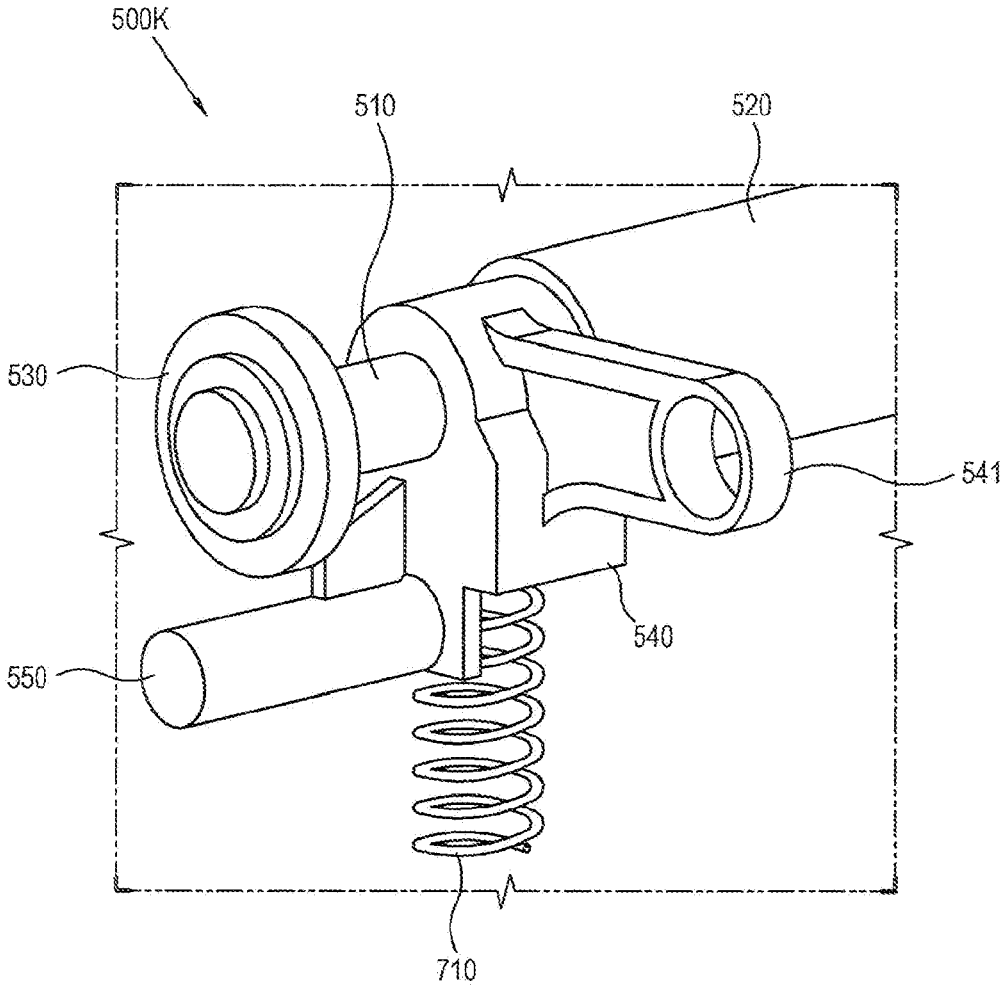
FIG. 7 is a perspective view illustrative of an end portion of the transfer roller unit supported by the guide assembly of FIG. 5.

Referring to FIG. 7, the transfer roller 500K according to an embodiment may have the configuration of which the roller 520 and the distance regulating member 530 are coupled to the rotation shaft 510 whereas the holder 540 supports the rotation shaft 510 between the roller 520 and the distance regulating member 530.

The holder 540 may be elastically biased by the first elastic member 710 in the direction of moving the transfer roller 500K toward the transfer position. A hinge 541 may be provided to a side of the holder 540 so that the holder 540 can be movably coupled to the second transfer unit frame 300.

The transfer roller 500K may further include the holder protrusion unit 550 protruding from the holder 540. The holder protrusion unit 550, thus the transfer roller 500K, may supported by the first support guide 830 in such a manner the position of the holder protrusion unit 550 is regulated by the first support guide 830 so as to thereby regulate the movement of the transfer roller 500K. A hole may be provided the second transfer unit frame 300 so as to prevent the movement of the holder protrusion unit 550 from being interfered by the second transfer unit frame 300.

Figure 8:
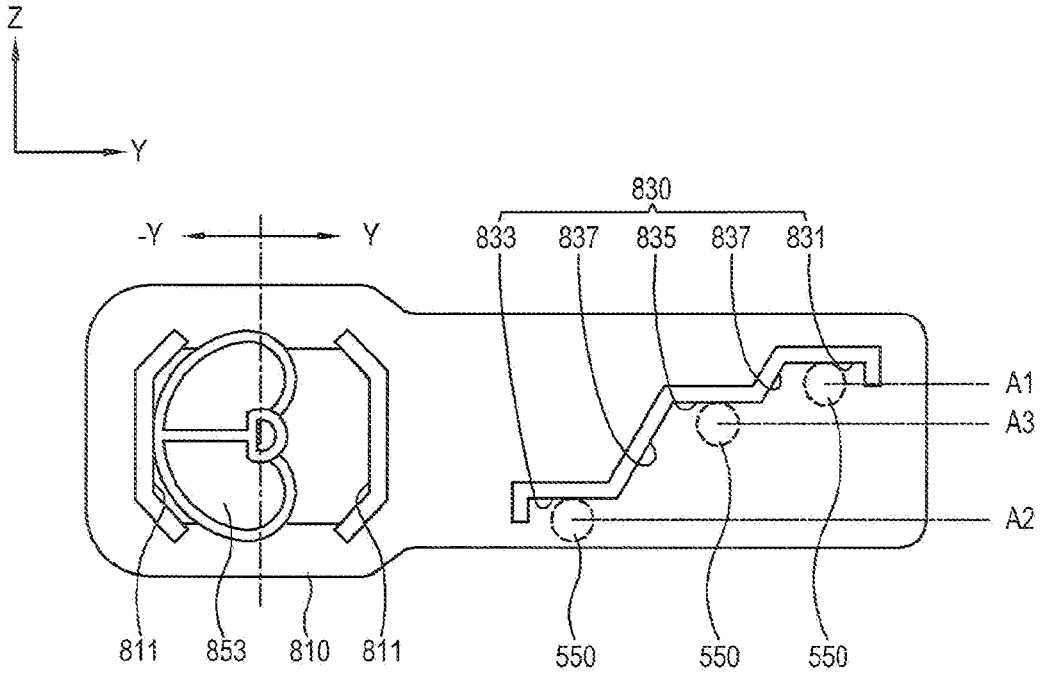
FIG. 8 is illustrative of the regulation of a holder protrusion unit by the support guide of the guide assembly of FIG. 5.

Referring to FIG. 8, the configuration of the first support guide 830 of the first slider member 810 according to an embodiment that is capable of regulating the movement of the transfer roller 500K in such a manner reducing the movement speed of the transfer roller 500K.

As shown in FIG. 8, as the first cam member 853 rotates, the cam profile of the first cam member 853 presses the pressed unit 811 so that the first slider member 810 moves in the direction Y or the direction −Y. The elastic force of the first elastic member 710 operates so that the holder protrusion unit 550 is biased to move in the direction Z. The first support guide 830 opposes the elastic bias so that the transfer roller 500K can be maintained in the transfer position or in the standby position.

For example, when the holder protrusion unit 550 is positioned in the position A1, the transfer roller 500K may be maintained in the transfer position whereas, when the holder protrusion unit 550 is positioned in the position A2, the transfer roller 500K may be maintained in the standby position.

To that end, the first support guide 830 may include a first support unit 831 that allows the holder protrusion unit 550 to be maintained at the position A1 and a second support unit 833 that allows the holder protrusion unit 550 to be maintained at the position A2.

The first support guide 830 may further include a third support unit 835 defining at least one intermediary step between the first support unit 831 and the second support unit 833. According to an embodiment, the third support unit 835 reduces the relative range of the movement of the holder protrusion unit 550 in which the holder protrusion unit 550 is allowed to accelerate when moving from the position A2 to the position A1 according to the movement of the first slider member 810, thereby reducing the speed of the holder protrusion unit 550 reaching the position A1. Accordingly, it is possible to reduce the force of impact of the transfer roller 500K on the image carrying body 23K when the transfer roller 500K reaches the transfer position.

As a further illustration of an embodiment of the present disclosure, operation of the regulation of the movement the transfer roller 500K is now described in greater detail. The holder protrusion unit 550 may be in the position A2 by the second support unit 833 as the initial state. In such state, when the first cam member 853 rotates, as the cam profile of the first cam member 853 presses the pressed unit 811, the first slider member 810 moves in the direction −Y.

Accordingly, the first support guide 830 formed on the first slider member 810 also moves in the direction −Y. As the first support guide 830 moves in the direction −Y, the portion of the first support guide 830 in contact with the holder protrusion unit 550 changes from the second support unit 833 to the third support unit 835, allowing the holder protrusion unit 550 moves from the position A2 to a position A3. At such time the holder protrusion unit 550 is in contact with the third support unit 835, the movement speed of the holder protrusion unit 550 is reduced in comparison to the time just before the holder protrusion unit 550 reaching the position A3.

If the first slider member 810 further moves in the direction −Y, the first support guide 830 moves in the direction −Y, and, accordingly, the holder protrusion unit 550 moves from the position A3 to the position A1. As the movement speed of the holder protrusion unit 550 is reduced in the position A3, the movement speed of the holder protrusion unit 550 when reaching the position A1 is also reduced.

If the rotation of the first cam member 853 is stopped in state of the holder protrusion unit 550 being in the position A1, the transfer roller 500K is maintained in the transfer position.

Absent the third support unit 835 in the first support guide 830, as the first slider member 810 moves in the direction −Y, the holder protrusion unit 550 may move from the position A2 directly to the position A1 without any interference. In such a case, the length or range of movement in which the holder protrusion unit 550 is accelerated by the elastic force of the first elastic member 710 is the entire movement range from the position A2 to the position A1.

With the above described configuration according to an embodiment that includes the third support unit 835, the range of movement in which the holder protrusion unit 550 is allowed to accelerate is the movement from the position A3 and the position A1, and is thus shorter than the case without the third support unit 835. Since the momentum of the holder protrusion unit 550 increases with an increase in the allowed acceleration, the force of impact transmitted to the image carrying body 23K at reaching the position A1 also increases when the third support unit 835 is not provided.

Accordingly, by reducing the movement distance in which the holder protrusion unit 550 is allowed to accelerate, by the use of the third support unit 835, the momentum of the holder protrusion unit 550 can be reduced, and, accordingly, the force of impact can be reduced.

When the first cam member 853 is rotated so that the first slider member 810 moves in the direction Y from the position it had when the holder protrusion unit 550 is supported by the first support unit 831 to maintain the position A1, the first support guide 830 moves in the direction Y, and, accordingly, the holder protrusion unit 550 moves to the position A2 via the position A3.

By stopping the rotation of the first cam member 853 when the holder protrusion unit 550 reaches the position A2, the holder protrusion unit 550 can be maintained in the position A2, thus allowing the transfer roller 500K to be maintained in the standby position.

The inclined unit(s) 837 may be provided between the first support unit 831 and the third support unit 835, and/or between the third support unit 835 and the second support unit 833, for guiding the movement of the holder protrusion unit 550. For example, when the first support guide 830 moves in the direction Y, the inclined unit(s) 837 allows an easier movement of the holder protrusion unit 550 from the first support unit 831 to the third support unit 835, or from the third support unit 835 to the second support unit 833.

While according to an embodiment, for purposes of illustration, the third support unit 835 is described to include a single step formed between the first support unit 831 and the second support unit 833, it should be understood that the third support unit 835 may include two or more of steps.

According to an embodiment, the respective positions of the first transfer roller unit that includes the transfer roller 500K and the second transfer roller unit that includes the transfer rollers 500C, 500M and 500Y may be controlled to correspond to the intended printing mode of the image forming apparatus 1.

Figure 9:
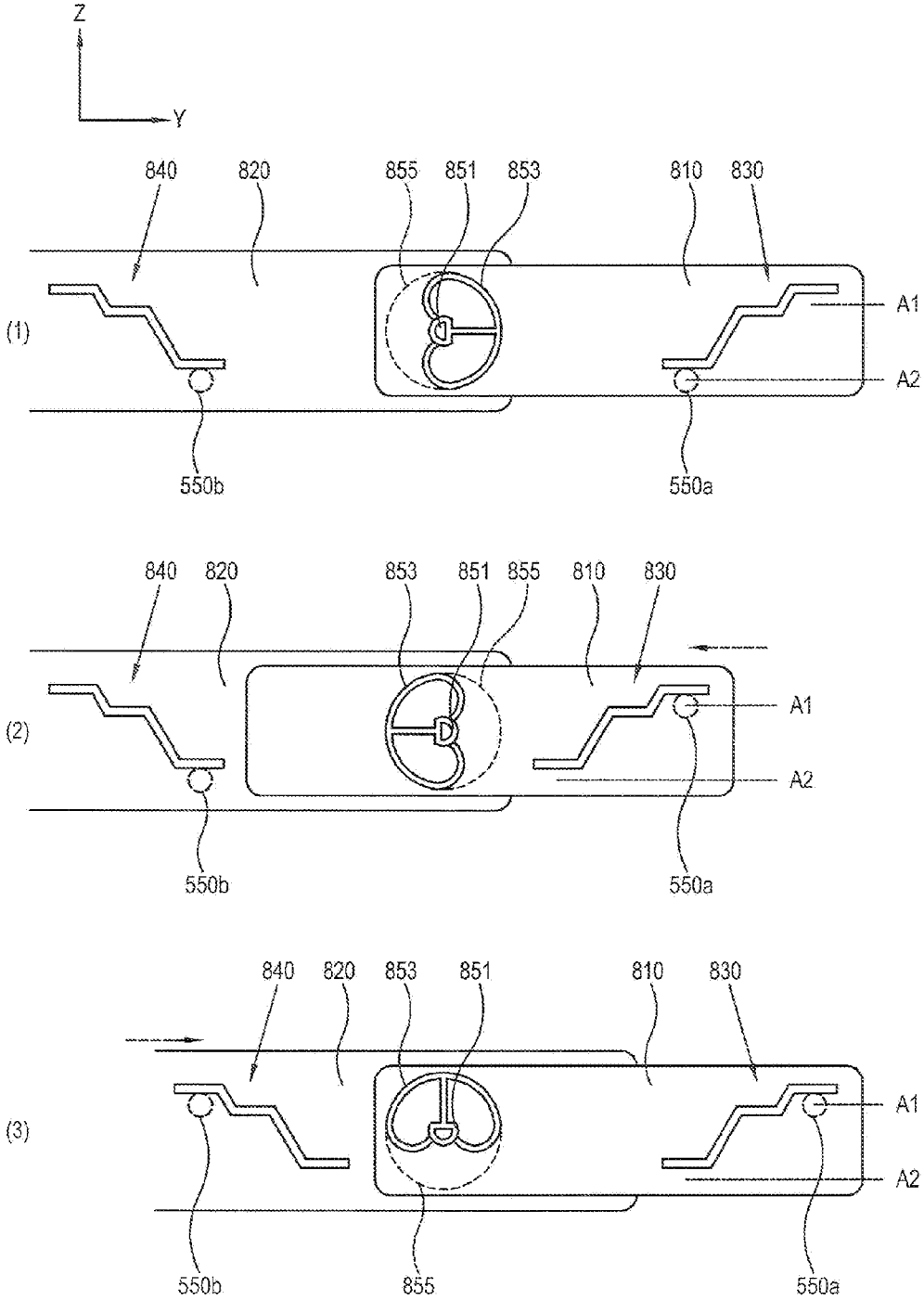
FIG. 9 is illustrative of the guide assembly of FIG. 5 in various configurations corresponding to the various printing modes.

For example, referring to FIG. 9, (1), (2) and (3) illustrate the states of the guide assembly 800 respectively corresponding to the standby mode, the monochromatic printing mode and the color printing mode.

In the standby mode, as shown in FIG. 9(1), the first holder protrusion unit 550*a* of the transfer roller 500K and the second holder protrusion unit(s) 550*b* of the second transfer roller unit, for example, of the transfer rollers 500C, 500M and 500Y, are each maintained at the position A2 by the first support guide 830 and the second support guide 840, respectively. Accordingly, the first transfer roller unit, for example, the transfer roller 500K, and the second transfer roller unit, for example, transfer rollers 500C, 500M and 500Y, are both separated from the respective corresponding image carrying bodies 23C, 23M, 23Y and 23K by a distance during the standby mode in which no printing operation is to be performed.

In the monochromatic printing mode, as illustrated in FIG. 9(2), as the cam rotation shaft 851 rotates to in turn rotate the first cam member 853 and the second cam member 855, the cam profile of the first cam member 853 moves the first slider member 810 in the direction −Y while the cam profile of the second cam member 855 does not move the second slider member 820.

Accordingly, the first holder protrusion unit 550*a* moves from the position A2 to the position A1 while the second holder protrusion unit 550*b* remains in the position A2. Accordingly, the transfer roller 500K moves to the transfer position so as to be capable of forming an image with black developer while the second transfer roller unit, including the transfer rollers 500C, 500M and 500Y for developer of other colors, is maintained in the standby position.

The speed at which the first holder protrusion unit 550*a* reaches the position A1 is reduced as described above, thereby reducing the force of impact with which the transfer roller 500K contacts the image carrying body 23K.

If the color printing mode is entered from the monochromatic printing mode, both the first cam member 853 and the second cam member 855 may be rotated. However, since the first holder protrusion unit 550*a* already in the position A1, the cam profile of the first cam member 853 does not cause the first slider member 810 to move whereas the cam profile of the second cam member 855 causes the second slider member 820 to move in the direction Y so as to allow the second holder protrusion unit 550*b* to move from the position A2 to the position A1. With the second support guide 840 of the above described configuration, the force of impact with which the second transfer roller unit contacts the corresponding image carrying bodies can be reduced.

As all of the first holder protrusion unit(s) 550*a* and the second holder protrusion unit(s) 550*b* move to the position A1 as shown in FIG. 9(3), both the first and second transfer roller units move to the transfer position, allowing the transfer unit 40 to transfer the black, cyan, magenta and yellow images to form a color image.

If the color printing mode is to be entered from the standby mode, the cam profiles of the first cam member 853 and the second cam member 855 move the first slider member 810 in the direction −Y and the second slider member 820 in the direction Y, respectively, as the cam rotation shaft 851 rotates. Accordingly, the first holder protrusion unit(s) 550*a* and the second holder protrusion unit(s) 550*b* all move from the position A2 to the position A1.

If the standby mode is to be entered from the color printing mode, the cam profiles of the first cam member 853 and the second cam member 855 move the first slider member 810 in the direction Y and the second slider member 820 in the direction −Y, respectively. Accordingly, the first holder protrusion unit(s) 550*a* and the second holder protrusion unit(s) 550*b* all move from the position A1 to the position A2, causing both the first and second transfer roller units to move to the standby position.

With the above described configuration, the positions of the transfer roller units, that is, the transfer rollers 500K, 500C, 500M and 500Y, individually or in some combination, can be selectively controlled to correspond to the selected one of the printing modes.

An illustrative example of the process of controlling the position of transfer rollers 500C, 500M, 500Y and 500K to correspond to the selected printing mode according to an embodiment will be described in reference to FIG. 10, in which an illustrative example of the control flowchart is shown.

For the sake of convenience, in the following description of the control process, the black transfer roller unit refers to the transfer roller 500K for transferring the black image while the color transfer roller unit refers to the three transfer rollers 500C, 500M and 500Y for transferring respectively cyan, magenta and yellow images.

As shown in FIG. 10, assuming for purposes of illustration that the image forming apparatus is initially in the standby mode in which a printing operation is not performed, the black transfer roller 500K and the color transfer roller unit 500C, 500M and 500Y are all in the standby position (S100).

If a printing process is initiated (S110), the controller 859 determines, for example, by examining the print commend or request, whether the present printing process is for forming a monochromatic image (S120).

If the controller 859 determines that a monochromatic image is to be formed, and thus that the printing process is to be carried out in the monochromatic printing mode, the controller 859 moves the black transfer roller unit to the transfer position, and maintains the color transfer roller unit in the standby position (S130).

If, on the other hand, in step (S120), the controller 859 determines that the intended image is not a monochromatic image, the controller 859 further determines whether a color image is to be formed, and thus that the printing process is to be carried out in the color printing mode (S140). If the controller 859 determines that the printing is to be carried out in the color printing mode, the controller 859 moves both the black transfer roller unit and the color transfer roller unit to the transfer position (S150).

Once the black transfer roller unit and the color transfer roller unit are positioned at the conclusion of the operation 5130 or the operation 5150, the transfer unit 40 transfers the image(s) from one or more of the image carrying bodies 23C, 23M, 23Y and 23K (S160). That is, if the transfer roller units are positioned according to the operation S130, the transfer of image involves only the black transfer roller unit, forming a monochromatic image using the black developer. On the other hand, if the transfer roller units were positioned according to the operation S150, transfers of images by the black transfer roller unit as well as the color transfer roller unit are performed, thus forming a color image.

The controller 859 determines whether the printing process is completed (S170), and, if it is determined that further printing process is to be carried out, the controller 859 returns to the operation S120 to determines the printing mode for the next image.

If it is determined that the printing process is completed, the controller 859 moves both the black transfer roller unit and the color transfer roller unit to the standby position (S180).

While in the above description of one or more embodiments, the third support unit 835 is described as one or more intermediary steps to cause the transfer roller units to move in stages to thereby reduce the speed of the holder protrusion unit 550, it should be understood that such stepped configuration is described merely as an embodiment, and that other embodiments in which various other shapes and/or configuration of support unit(s) for reducing the speed of movement of the transfer roller units.

Figure 11:
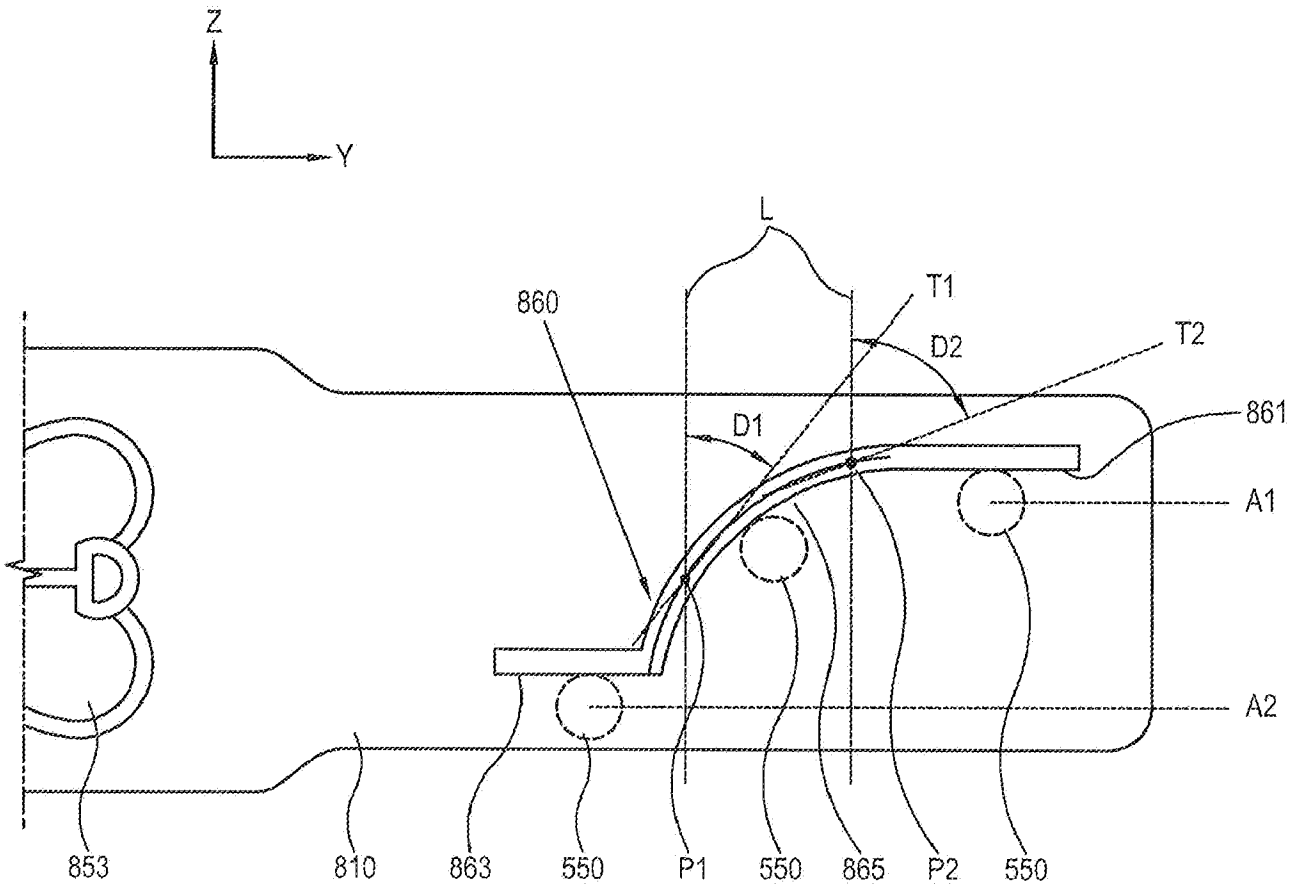
FIG. 11 illustrates the regulation of a holder protrusion unit by the support guide according to another embodiment of the present disclosure.

For example, illustrated in FIG. 11 is the configuration of a first support guide 860 according to another embodiment capable of regulating the holder protrusion unit 550.

Referring to FIG. 11, the first support guide 860 according to an embodiment may include a first support unit 861 supporting the holder protrusion unit 550 in the position A1, a second support unit 863 supporting the holder protrusion unit 550 in the position A2, and a third support unit 865 that extends between the first support unit 861 and the second support unit 863 and that allows the holder protrusion unit 550 to move gradually between the positions A1 and A2 to thereby reduce the movement speed of the holder protrusion unit 550.

The third support unit 865 extends to provide an arcuate travel path for the holder protrusion unit 550 between the first support unit 861 and the second support unit 863 so that the holder protrusion unit 550 moves gradually guided by the third support unit 865 at a reduced speed.

According to an embodiment, the support positions P1 and P2 supporting the holder protrusion unit 550 in the third support unit 865 at positions closer to the first support unit 861 and to the second support unit 863, respectively. In FIG. 11, T1 denotes the tangent line of the third support unit 865 at the support position P1. T2 denotes the tangent line the third support unit 865 at the support position P2. The two lines each labeled L represent the movement direction of the holder protrusion unit 550, i.e., the direction Z. According to an embodiment, the third support unit 865 is configured such that two angles D1 and D2, which are angles between L and T1 and between L and T2, respectively, satisfies the relationship D2>D1. That is, as the support position of the third support unit 865 becomes closer to the first support unit 861, the angle between the tangent line at the corresponding support position and a line L parallel to the movement direction of the holder protrusion unit 550 becomes bigger.

With the above described configuration of the third support unit 865, the interference with respect to the movement of the holder protrusion unit 550 along the Z direction increases as the holder protrusion unit 550 moves from the position A2 to the position A1. Such increasing interference according to an embodiment is not by stages but gradual, which allows, in comparison to the earlier described embodiments in which the movement of the holder protrusion unit 550 is in stages, a more stable reduction in the impact force.

According to one or more aspects of the present disclosure, the guide assembly according to one or more embodiments described herein can reduce the force of impact with which a transfer roller makes contact, with an image carrying body, and, accordingly, the likelihood of physical deformation of the image carrying body and of the attendant deterioration of image quality can be reduced.

A guide assembly according to one or more aspects of the present disclosure may reduce the movement speed of the transfer roller in stages or gradually.

According to one or more aspects of the present disclosure, the position of the transfer roller corresponding to the black developer may be controlled independently of the positions of the other transfer rollers corresponding respectively to other color developers, for example, of cyan, magenta, yellow, to thereby realize a convenient selective positioning of the transfer rollers according to the selected one of several available printing modes for prolonging the operational life of the image carrying bodies.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a main body frame;

an image carrying body supported on the main body frame, the image carrying body having a surface on which to support an image; and a transfer unit coupled to the main body frame, the transfer unit comprising:

an intermediate transfer belt configured to receive the image from the image carrying body;

a transfer roller configured to move between a first position at which the image from the image carrying body is transferred to the intermediate transfer belt and a second position at which the transfer roller is further away from the image carrying body than when the transfer roller is at the first position;

an elastic member elastically biasing the transfer roller toward the first position; and a guide assembly configured to guide a movement of the transfer roller in such a manner opposing an elastic force of the elastic member so as to cause the transfer roller to contact the image carrying body with a reduced force of impact when the transfer roller moves from the second position to the first position, the guide assembly reducing a movement speed at which the transfer roller moves from the second position to the first position.

2. The image forming apparatus according to claim 1, wherein the guide assembly reduces the movement speed of the transfer roller unit in one or more stages.

3. The image forming apparatus according to claim 1, wherein the guide assembly reduces the movement speed of the transfer roller unit gradually.

4. The image forming apparatus according to claim 1, wherein the guide assembly comprises:

a slider member movably coupled to the main body frame;

a support guide formed on the slider member, the support guide extending along a direction of movement of the slider member and being arranged to contact at least a portion of the transfer roller so as to guide the transfer roller in such a manner allowing a position of the transfer roller to vary correspondingly with a movement of the slider member; and a driving unit configured to drive the slider member to move.

5. The image forming apparatus according to claim 4, wherein the driving unit comprises:

a cam member rotationally driven by a driving force source, the cam member having a cam profile that selectively presses the slider member to move according to a rotational position of the cam member; and a controller configured to control the rotational position of the cam member so as to allow the slider member to move selectively according to a selected one of printing modes in which the image forming apparatus is capable of operating.

6. The image forming apparatus according to claim 5, wherein the transfer roller comprises:

a roller body rotatable about a rotational shaft; and a distance regulating member arranged on at least one end portion of the rotational shaft, the distance regulating member being configured to contact the image carrying body to maintain a distance between the roller body and the image carrying body when the transfer roller unit is positioned in the first position.

7. The image forming apparatus according to claim 6, wherein the transfer roller further comprises:

a holder configured to rotatably support the rotational shaft, the holder being coupled to the elastic member so as to receive therefrom the elastic force; and a holder protrusion formed on the holder, the holder protrusion being supported by the support guide.

8. The image forming apparatus according to claim 4, wherein the support guide comprises:

a first support portion configured to support the transfer roller when the transfer roller is in the first position;

a second support portion configured to support the transfer roller when the transfer roller is in the second position; and a third support portion arranged between the first support portion and the second support portion so as to support the transfer roller in such a manner allowing the transfer roller to be positioned at least one intermediary position between the first position and the second position.

9. The image forming apparatus according to claim 8, wherein the support guide further comprises:

an inclined portion arranged at least one of between the first support portion and the third support portion and between the third support portion and the second support portion, the inclined portion being configured to guide at least one of the movement of the transfer roller from the first position to any one of the at least one intermediary position and the movement of the transfer roller from any one of the at least one intermediary position to the second position.

10. The image forming apparatus according to claim 4, wherein the support guide comprises:

a first support portion configured to support the transfer roller when the transfer roller is in the first position;

a second support portion configured to support the transfer roller when the transfer roller is in the second position; and a third support portion arranged between the first support portion and the second support portion, the third support portion defining an arcuate guide path along which the transfer roller is guided to move between the first and second positions.

11. The image forming apparatus according to claim 10, wherein an angle between a tangent line of the third support portion at a support position of the transfer roller on the third support portion and a line parallel to the movement direction of the transfer roller becomes larger as the support position becomes closer to the first support portion.

12. The image forming apparatus according to claim 4, wherein the image supported on the image carrying body is formed of black developer, the transfer unit further comprises:

at least one additional transfer roller arranged to be parallel to the transfer roller, the at least one additional roller corresponding to at least one additional image carrying body on which additional image formed of developer of at least one color other than black, wherein the guide assembly further comprises: an additional slider member movably coupled to the main body frame; and one or more additional support guides formed on the additional slider member, the one or more additional support guides each extending along a direction of movement of the additional slider member and being arranged to contact at least a portion of corresponding one of the at least one additional transfer roller so as to guide the corresponding one of at least one additional transfer roller in such a manner allowing a position of the corresponding one of the at least one additional transfer roller to vary correspondingly with the movement of the additional slider member, and wherein the driving unit is further configured to drive the additional slider member to move.

13. The image forming apparatus according to claim 12, wherein the driving unit comprises:

a first cam member having a first cam profile that is configured to press against the slider member and to thereby cause the slider member to move;

a second cam member coupled coaxially with the first cam member, the second cam member having a second cam profile that is configured to press against the additional slider member and to thereby cause the additional slider member to move; and a controller configured to control rotational positions of the first and second cam members so as to allow the slider member and the additional slider member to move selectively according to a selected one of printing modes in which the image forming apparatus is capable of operating.

14. The image forming apparatus according to claim 13, wherein the controller is configured to control the rotational positions of the first and second cam members in such a manner that each of the transfer roller and the at least one additional transfer roller is positioned in the second position in a standby mode, in which mode the image forming apparatus does not perform a printing operation, that the transfer roller and the at least one additional transfer roller are positioned in the first position and in the second position, respectively, in a monochromatic printing mode, in which mode the image forming apparatus forms a monochromatic image, and that each of the transfer roller and the at least one additional transfer roller is positioned in the first position in a color printing mode, in which mode the image forming apparatus forms a color image.

15. A transfer unit of an image forming apparatus to transfer an image formed on an image carrying body with developer, comprising:

an intermediate transfer belt to which the image from the image carrying body is to be transferred;

a transfer roller configured to move between a first position at which the image from the image carrying body is transferred to the intermediate transfer belt and a second position at which the transfer roller is further away from the image carrying body than when the transfer roller is at the first position;

an elastic member elastically biasing the transfer roller toward the first position; and a guide assembly configured to guide a movement of the transfer roller in such a manner opposing an elastic force of the elastic member so as to cause the transfer roller to contact the image carrying body with a reduced force of impact when the transfer roller moves from the second position to the first position, the guide assembly reducing a movement speed at which the transfer roller moves from the second position to the first position.

16. An image transfer apparatus useable in an image forming apparatus to receive an image from an image carrying body on which the image is developed with developer, comprising:

a transfer roller arranged to be movable along a first direction between at least a transfer position at which the image transfer apparatus receives the image from the image carrying body and a standby position at which the transfer roller is spaced apart from the image carrying body by a distance greater than when the transfer roller is positioned in the transfer position; and a guide member having a guide surface, at least a portion of which guide surface extending along a second direction not parallel to the first direction and that is in an interfering contact with a portion of the transfer roller to thereby interfere with a movement of the transfer roller along the first direction at least when the transfer roller moves from the standby position to the transfer position; and a guide member driving unit to drive the guide member along a third direction perpendicular and a direction opposite to the third direction to move the transfer roller between the transfer position and the standby position.

17. The image transfer apparatus of claim 16, wherein the guide member comprises:

a first support portion extending substantially perpendicular to the first direction, the first support portion being in contact with the portion of the transfer roller when the transfer roller is positioned in the transfer position;

a second support portion extending substantially perpendicular to the first direction, the second support portion being in contact with the portion of the transfer roller when the transfer roller is positioned in the standby position; and a third support portion extending substantially perpendicular to the first direction, the third support portion being in contact with the portion of the transfer roller when the transfer roller is positioned in an intermediary position between the transfer position and the standby position.

18. The image transfer apparatus of claim 16, wherein the guide member comprises:

a first support portion extending substantially perpendicular to the first direction, the first support portion being in contact with the portion of the transfer roller when the transfer roller is positioned in the transfer position;

a second support portion extending substantially perpendicular to the first direction, the second support portion being in contact with the portion of the transfer roller when the transfer roller is positioned in the standby position; and a third support portion extending curvedly between the first support portion and the second support portion, the third support portion having a first radius of curvature at a first location adjacent the first support portion that is larger than a second radius of curvature at a second location adjacent to the second support portion.

19. The image transfer apparatus of claim 16, wherein the guide member is configured to move along a direction perpendicular to the first direction.

20. An image forming apparatus, comprising:

an intermediate transfer belt to receive images from image carrying bodies;

a first transfer roller to transfer a first developer image from one of the image carrying bodies to the intermediate transfer belt;

a first slider member having a first support guide to gradually guide a movement of a first transfer roller between a first standby position and a first transfer position, the first support guide including:

a first transfer support portion to be in contact with a portion of the first transfer roller in the first transfer position;

a first standby support portion to be in contact with a portion of the first transfer roller in the first standby position; and a first intermediary support portion to be in contact with a portion of the first transfer roller in an intermediary position between the first transfer position and the first standby position to reduce a speed of a movement of the first transfer roller from the first standby position to the first transfer position; and a first cam member to drive the first slider member to move the first transfer roller between the first standby position and the first transfer position via the first support guide.

21. The image forming apparatus of claim 20, wherein the image forming apparatus further comprises:

a second transfer roller to transfer a second developer image from the second image carrying body to the intermediate transfer belt;

a second slider member having a second support guide to gradually guide a movement of the second transfer roller between a second standby position and a second transfer position;

a second cam member to drive the second slider member to move the second transfer roller between the second standby position and the second transfer position via the second support guide.

22. The image forming apparatus of claim 21, wherein the second support guide comprises:

a second transfer support portion to be in contact with a portion of the second transfer roller in the second transfer position;

a second standby support portion to be in contact with a portion of the second transfer roller in the second standby position; and a second intermediary support portion to be in contact with a portion of the second transfer roller in an intermediary position between the second transfer position and the second standby position to reduce a speed of a movement of the second transfer roller from the second standby position to the second transfer position.

23. The image forming apparatus of claim 21, wherein the image forming apparatus further comprises:

a cam rotation shaft to couple the first cam member and the second cam member to rotate the first and second cam members.

* * * * *